United States Patent [19]

Montgomery

[11] Patent Number: 4,568,299

[45] Date of Patent: Feb. 4, 1986

[54] METHOD AND APPARATUS FOR MAKING ARTICLES WITH COMPLEX SURFACES SUCH AS FRAMES FOR BOAT MODEL KITS

[76] Inventor: Arthur C. Montgomery, 243 Rowayton Ave., Rowayton, Conn. 06853

[21] Appl. No.: 457,460

[22] Filed: Jan. 12, 1983

[51] Int. Cl.[4] ..... A63H 33/04; A63H 27/02

[52] U.S. Cl. ..... 446/86; 446/88; 446/160; 114/358

[58] Field of Search ..... 446/160, 163, 88, 87, 446/93; 114/355, 358, 359, 357, 65 R, 114, 446; 144/372, 363, 350, 355, 369

[56] References Cited

U.S. PATENT DOCUMENTS

| | | | |
|---|---|---|---|
| 833,511 | 10/1906 | Dean . | |
| 1,259,572 | 3/1918 | Wilcox . | |
| 1,639,707 | 8/1927 | Shaver . | |
| 1,994,274 | 3/1935 | Gordon | 46/37 |
| 2,243,372 | 5/1941 | Chlopicki | 9/6 |
| 2,392,834 | 1/1946 | Clement, Jr. | 114/358 |
| 3,793,768 | 2/1974 | Surving | 46/1 |
| 4,184,285 | 1/1980 | Pibet | 446/93 |

FOREIGN PATENT DOCUMENTS

| | | | |
|---|---|---|---|
| 482946 | 4/1938 | United Kingdom | 446/97 |
| 607241 | 8/1948 | United Kingdom . | |
| 1257666 | 12/1971 | United Kingdom | 446/92 |

OTHER PUBLICATIONS

"Plank-on-Frame Models and Scale Masting and Rigging", vol. I, by H. A. Underhill, published by Brown, Son and Ferguson Ltd., Glasgow, 1971, p. 38.

*Primary Examiner*—Mickey Yu

*Attorney, Agent, or Firm*—Louis H. Reens

[57] ABSTRACT

A technique is described for the making of frames for an authentic plank-on-frame ship model kit. A wooden boat hull is made with a hull thickness that is the same for that of the frames. The hull has the internal and external surface contours desired for the ship model. The boat hull is then sliced at regular intervals to form individual segments representative of the desired frames. A set of frames is then selected from the sliced segments for an authentic plank-on-frame ship model.

18 Claims, 20 Drawing Figures

Fig. 4.
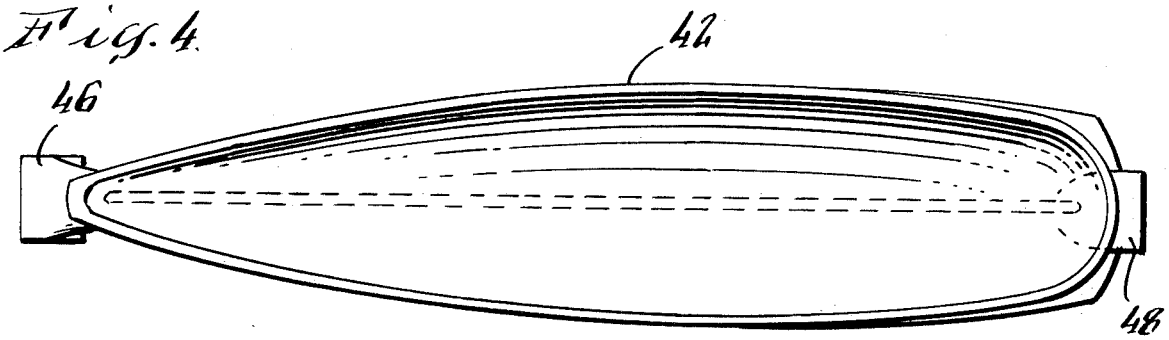
Fig. 5.
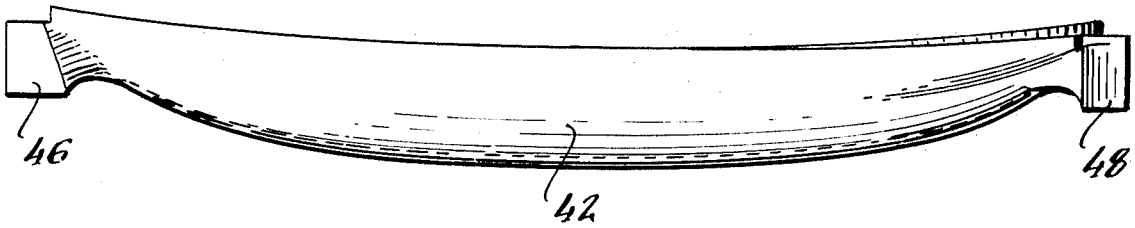
Fig. 6.
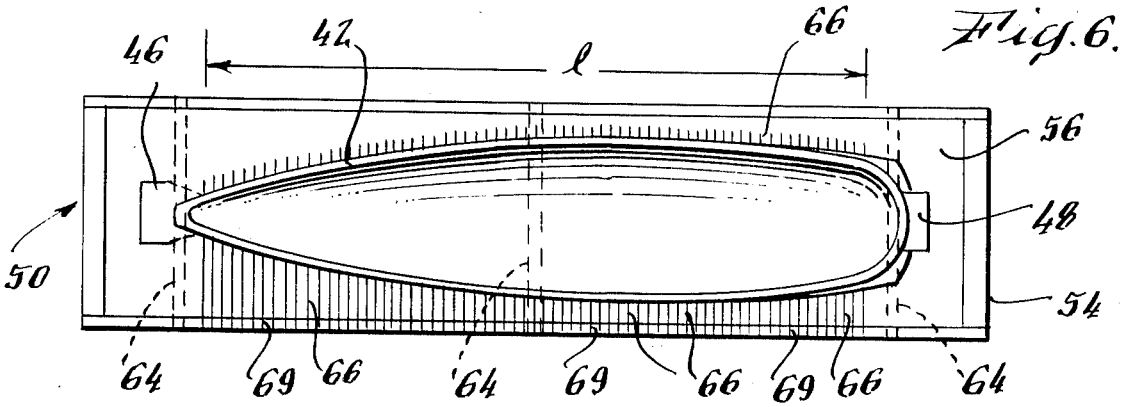
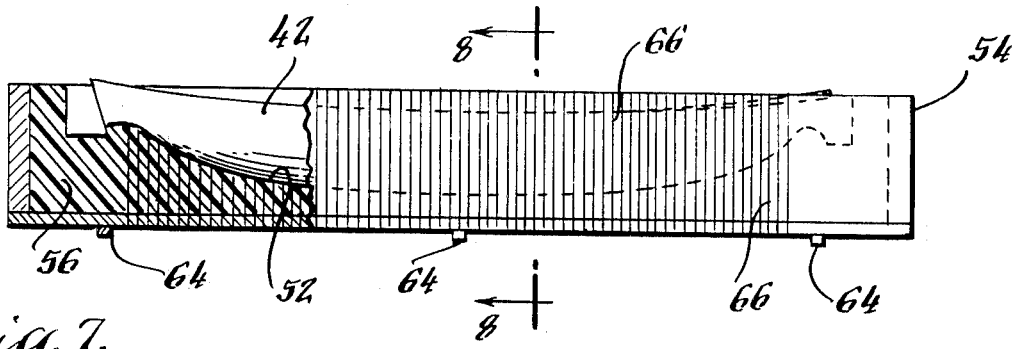
Fig. 7.

22a
38
40
14

40
36
22a
40

28
84
26
15
22a
15
84
84
14
26

32
30

22b
30
26
32
19
22b
30
28
84
26

22b
30
18
32
18
84
84
26
19

METHOD AND APPARATUS FOR MAKING ARTICLES WITH COMPLEX SURFACES SUCH AS FRAMES FOR BOAT MODEL KITS

FIELD OF THE INVENTION

This invention generally relates to a set of articles for making a model and a method and apparatus for making the articles for a model such as of a boat, airplane or other object having a complex surface. More specifically, this invention relates to sets of frames having compound beveled surfaces for a boat model and a method and apparatus for making such frames.

BACKGROUND OF THE INVENTION

Boat model making is an art that is very old. In the early days of making large scale sailing vessels, an initial step involved the manufacture of a scaled down model that would resemble the final vessel as closely as possible. Such model would include frames or ribs to which planks could be fastened with a flush (fair) fit. These frames would be affixed to a keel rib and when so attached would define both the external hull contour and the inboard contour. Ship hull contours are complex and dictate that the inboard as well as outboard faces of most of the frames are different to obtain a flush fit of the outside planks and stringers employed inside to reinforce the hull. The ship hull contours commonly require that the internal and external surfaces of any one frame have different bevels at different locations along the length of the frame. The making of an accurate model for a ship thus involved a substantial effort and time.

Boat model making is also a hobby with many books written on the subject. See, for example, "Plank-on-Frame Models and Scale Masting and Rigging" Volume I, by H. A. Underhill published by Brown, Son and Ferguson Ltd., Glasgow 1971. In this book a section is devoted to the making of a true plank-on-frame model (see page 38 and FIG. 5) where the frames have the desired bevels so as to obtain a fair and flush fitting of planks when these are applied.

Techniques have been proposed to make so-called plank-on-frame boat models, though these in practice do not use truly authentic beveled frames. For example, the U.S. Patent to Wilcox, No. 1,259,572 describes a boat hull wherein the frames, or ribs as they are also called, are formed of a plate of wood with the edges of the plate beveled in accordance with the angle of the boat model skin. Beveling is effected with a lathe or turning machine so that a plurality of ribs can be simultaneously beveled. This technique does not produce a true plank-on-frame design in that it does not provide an inboard bevel on the frames and does not obtain a bevel which varies over the height of the frame as is frequently required.

Similar shortcomings are found in other boat model art such as U.S. Pat. Nos. to Dean, 833,511; Shaver, 1,639,707; Gordon, 1,994,274; Chlopicki, 2,243,372 and Surving, 3,793,768; as well as British Pat. No. 607,241 to Lyons.

When boat models using a true plank-on-frame construction are to be made, the complexity in the manufacture of the frames or ribs with their compound surfaces tends to render such models to be excessively complex and expensive to make.

SUMMARY OF THE INVENTION

With a method for making boat models in accordance with the invention, a true plank-on-frame model can be made in a convenient elegantly simple manner yet with frames or ribs that may have any desired beveled surface as is necessary to make the model.

This is obtained by forming a model of a boat hull having the desired shape and then slicing the hull so as to intersect the external hull surface and divide the hull into segments. The segments may then be used to form the frames for a true plank-on-frame boat model.

As described herein in accordance with one technique for making frames for a plank-on-frame boat model kit, a plurality of wooden boat hulls are made from a common master. The boat hulls have external and internal shapes that correspond to that desired for the final ship model. The boat hulls are made generally as thick as the thickness intended for the frames. Each wooden hull is then placed in a cradle which provides external hull support. The cradle is sliced so as to cut the hull in a generally athwartship manner and thus divide the hull into segments. Segments are then selected to form a set of frames.

The frames automatically have the external and internal beveled surfaces that accurately represent the ship hull contours, yet are convenient to make. In some instances a single slicing of a boat hull may yield several sets of frames when, for example, alternate segments are selected.

Slicing of the boat hulls preferably involves use of a cradle that is capable of comfortably and peripherally supporting the boat hull along its length while the hull is sliced. The hull support is provided at discrete spaced locations along its length and hull slices are made between the locations. In accordance with one technique for making frames in accordance with the invention, such cradle support is obtained by producing a form with a recess whose shape corresponds to that of the external surface of the boat hull. The form is then sliced at regular intervals when a boat hull is placed in the recess. Slicing of the form is partial so as to retain its integrity and reuseability while the hull is completely sliced into segments.

With a technique for making frames in accordance with the invention for plank-on-frame boat models, the frames can be rapidly made by slicing each boat hull with a plurality of saws and automatic manufacturing techniques can be adopted. The technique of this invention may be applied to the manufacture of other objects having complex beveled surfaces such as may be used in the making of airplane models and the like.

It is, therefore, an object of the invention to provide a method and apparatus for making objects having complex surfaces. It is a further object of the invention to provide a method and apparatus for making frames for an authentic plank-on-frame boat model. It is still further an object of the invention to provide frames for plank-on-frame boat model kits.

These and other objects and advantages of the invention can be understood from the following description of a technique for making frames in accordance with the invention and described in conjunction with the drawings.

BRIEF DESCRIPTION OF DRAWINGS

FIG. 4 is a top plan view of a boat hull made with the apparatus of FIG. 3;

FIG. 5 is a side view in elevation of the boat hull shown in FIG. 3;

FIG. 6 is a top plan view of a cradle used to make boat model frames in accordance with the invention;

FIG. 7 is a side view in elevation and in partial section of the cradle shown in FIG. 6;

DETAILED DESCRIPTION OF DRAWINGS

Figure 1:
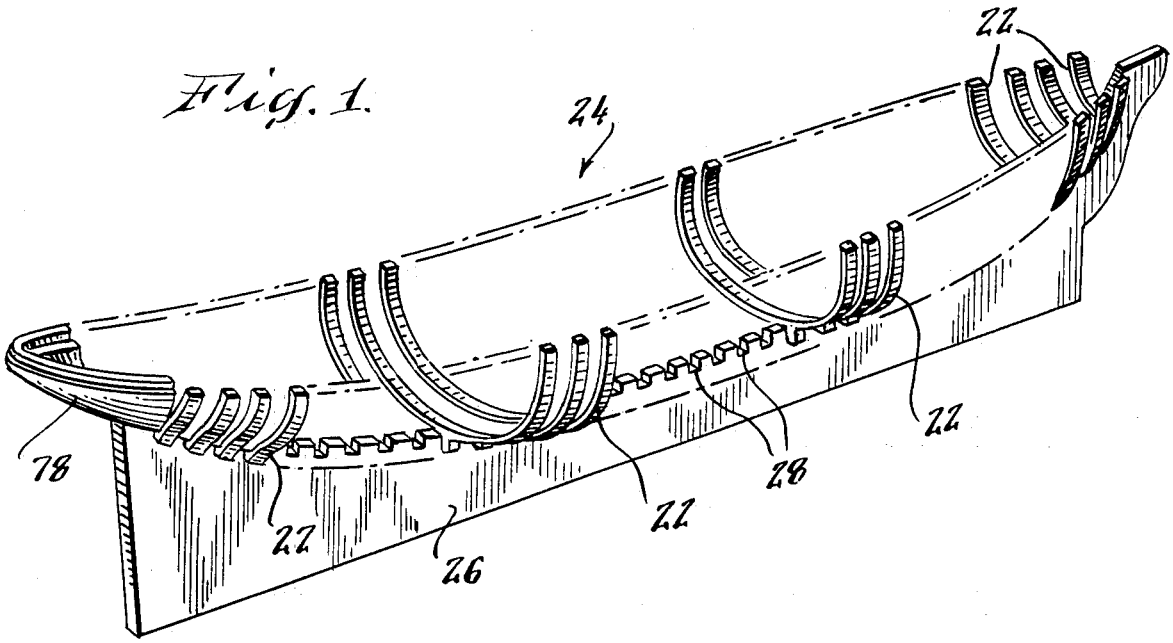
FIG. 1 is a perspective view of a set of boat model frames made in accordance with the invention and mounted on a keel.
Figure 2:
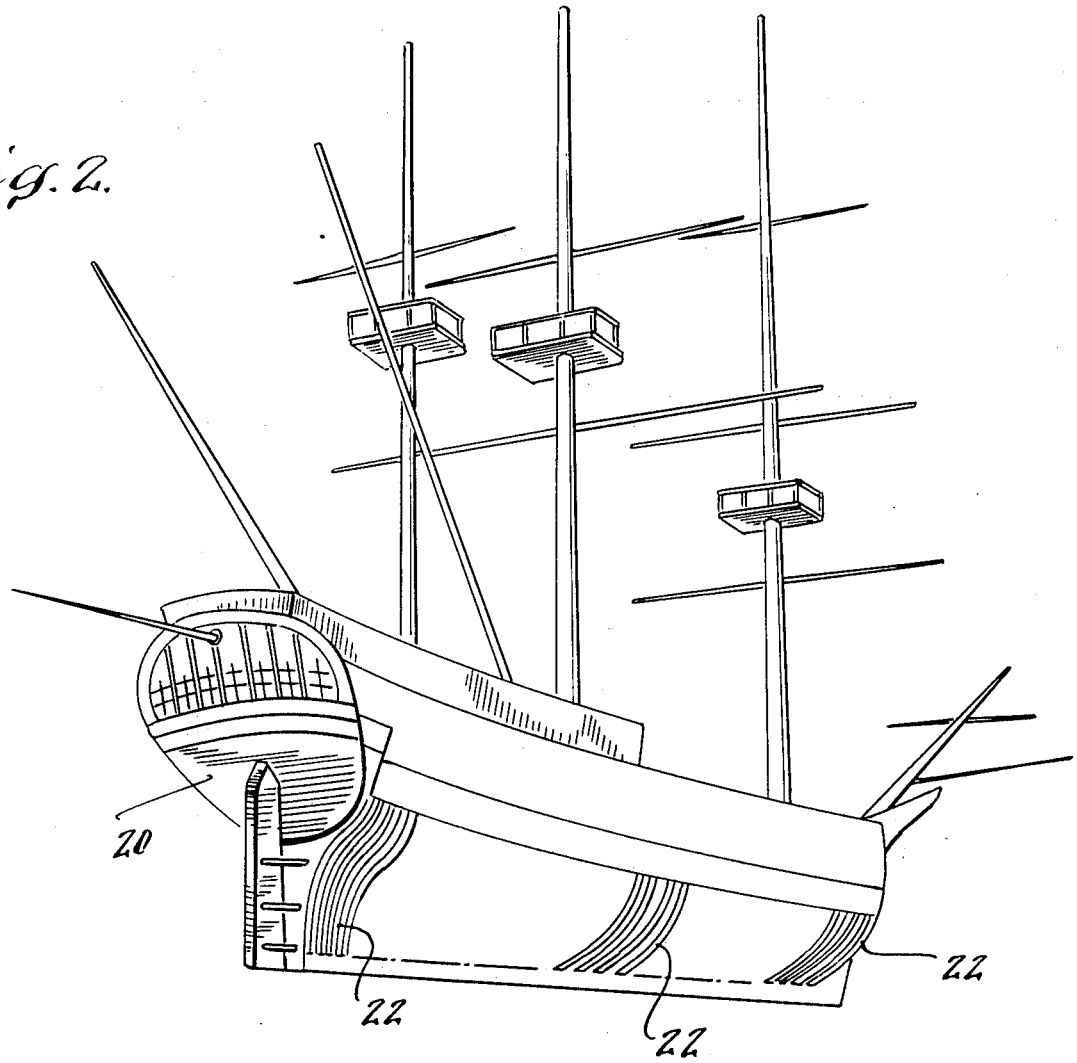
FIG. 2 is a perspective view of a boat model made with frames in accordance with the invention.

With reference to FIGS. 1 and 2, a boat model 20 is shown made with frames 22 that were formed in accordance with the invention and with which an authentic plank-on-frame boat model 20 can be made. The frames 22 are part of a set 24 which is shown assembled on a keel 26 in FIG. 1. The boat model 20 is illustrated completed without lower planking as is often done in the art of making models when the frames are to be displayed. The keel 26 is shown at its upper end provided with recessed slots 28 sized to snugly receive and retain frames 22. However, slots 28 can be deleted if desired.

The complexity of making authentic frames 22 can be appreciated with reference to FIGS. 13 through 20 where a forward frame **22.*a* and a mid-frame 22.*b* are illustrated. The mid-frame 22.*b* has straight external and internal surfaces 30, 32. The forward frame 22.*a*, however, has an external surface 34 whose bevel is neither straight nor consistently the same along the frame length as can be observed at 36 in FIG. 15 and 38 in FIG. 16. In addition, the frame's internal surface 40 has a bevel that is often different from that of the external surface 34**.

These bevels are dictated by the curvature of the boat hull whose contours are complex for reasons that are well known in the area of ship building. As a result, however, the frames 22 are all different and the manufacture of any one frame from construction drawings is difficult. The manufacture of boat model kits to be assembled by others thus traditionally has not included authentically shaped ribs, thus making a true plank-on-frame boat model hard to achieve.

Figure 3:
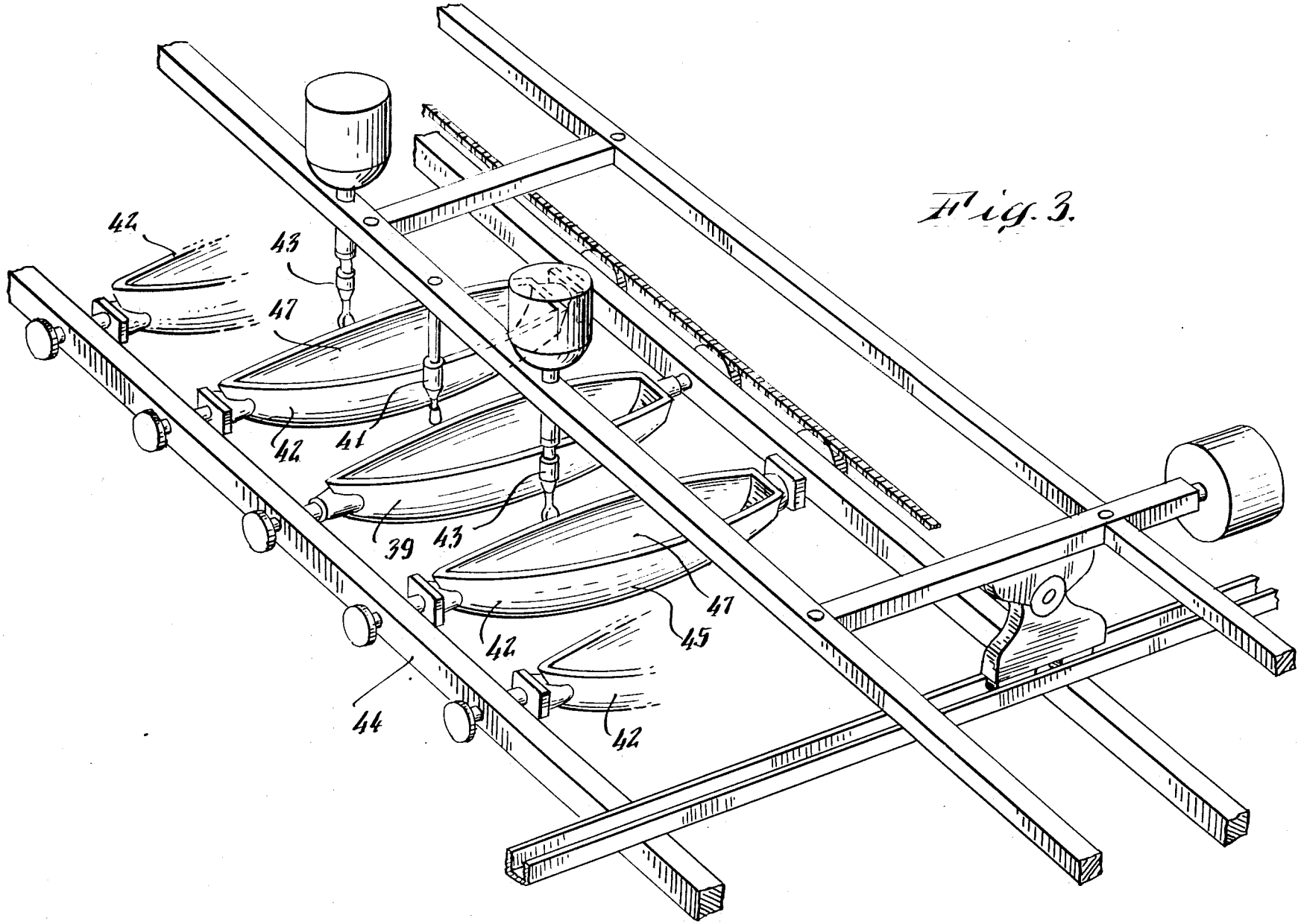
FIG. 3 is a partial perspective view of a machine for making boat hull models.

With a boat model in accordance with the invention, a set 24 of frames 22 with authentic beveled surfaces is obtained by first constructing a preform in the shape of a boat hull 42 in a conventional manner with a well known wood cutting machine 44 as partially shown in FIG. 3. Such machine 44 employs a master boat hull 39, usually of metal, and which is duplicated in wood by moving a large number of wooden blocks into contact with as many wood cutting elements 43 in correspondence with the motion of a stylus tracer or follower 41 that is in contact with the master. The resulting wooden hulls 42 have an identical shape to that of the master. The formation of the external surface 45 may utilize a different steel master and wood cutter than is needed to form the internal surface 47.

In the manufacture of hulls 42 they each have a thickness that corresponds to that of the frames 22 and with a shape that corresponds to that desired for the hull of boat model 20. The boat hulls 42 thus may have a shape as shown in FIGS. 4 and 5 with end located portions 46 and 48 that were used to hold the hulls in machine 44.

Figure 8:
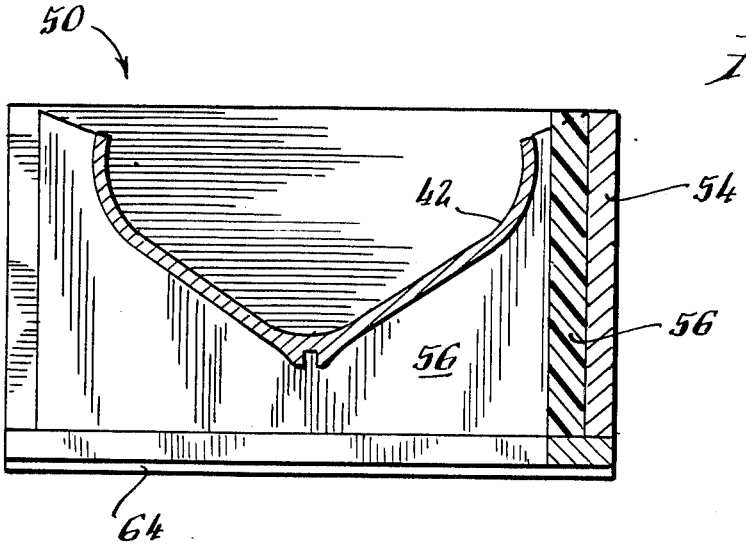
FIG. 8 is a section view of the cradle of FIG. 7 with a boat hull placed in the cradle and as taken along the line 8—8 in FIG. 7.
Figure 9:
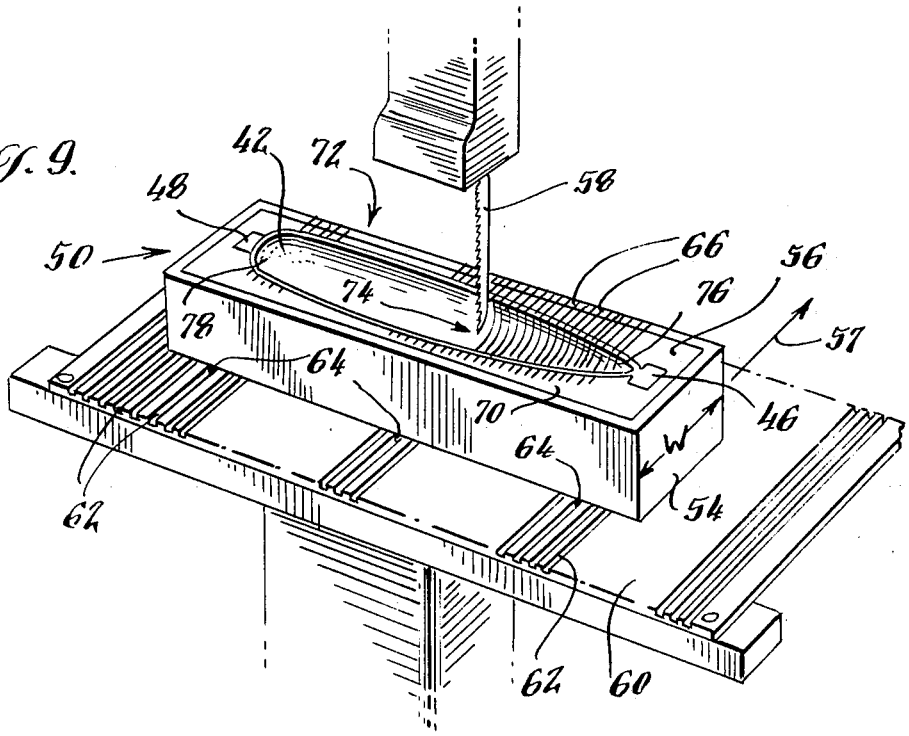
FIG. 9 is a perspective view of an apparatus employed to slice a boat hull.
Figure 10:
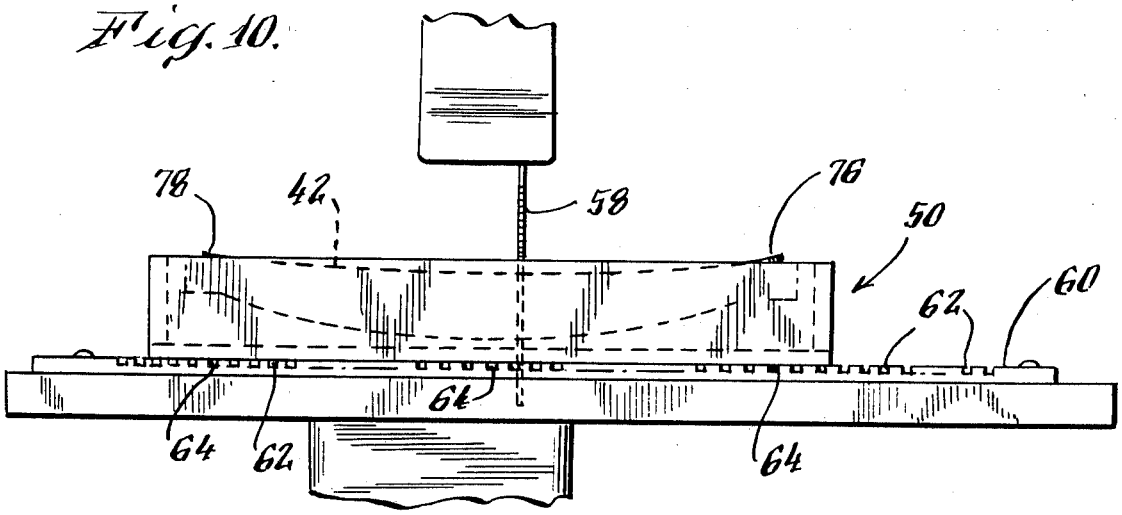
FIG. 10 is a side view in elevation of the apparatus shown in FIG. 9.

The hulls 42 are then placed, as shown in FIGS. 6–8 in a cradle 50 having a recess 52 that corresponds to the lower external surface of boat hulls 42 and portions 46, 48. Hence, when a boat hull 42 is placed in recess 52 of cradle 50, the hull is snugly supported on an extended region of the bottom of the hull 42. Such support then permits a subsequent slicing of the hull as illustrated in FIGS. 9 and 10.

Cradle 50 is in the form of a rectangular wooden box 54 filled with a molded form 56, both of which can be sliced by a conventional endless saw blade 58. The mold form may be of a suitable sliceable moldable material such as rubber or plastic. The saw passes through an aperture (not shown) in a plate 60 having a plurality of parallel slots 62 at regular intervals. The cradle 50 is provided with projecting ribs 64 spaced along the bottom of box 54 and shaped to slidingly fit in slots 62. The spacings between slides 64 is selected so that each fits into a slot 62 of plate 60 when the cradle 50 is placed on plate 60.

Slicing of the boat hull 42 is then obtained by placing cradle 50 on plate 60 and manually moving it against the moving saw blade 58 in the direction of arrow 57. A plurality of slices 66 are then made as shown by lifting the cradle 50 after each slice and indexing the cradle by one or more slots 60 until all of the desired slices 66 have been made. The slices 66 do not extend across the entire width W of cradle 50 lest the latter would be severed. Instead, the slices 66 are only extended as far as is needed to cut boat hull 42 as shown. This leaves an unsliced portion 70 of cradle 50 to hold the cradle together and enable its reuse.

Note that once cradle 50 has been sliced it is formed of separated hull supports 69 at discrete places along the length 1 (see FIG. 6). Each support 69 preferably cradles the segmented part of the sliced hull 42 along a continuous bottom portion for ease of handling and slicing of the boat hull.

For example, in FIG. 9 a boat hull 42 is shown placed in cradle 50 which has been previously used as illustrated by the slice marks at 72 while at 74 the boat hull is being cut along previously made slices of cradle 50.

Figure 11:
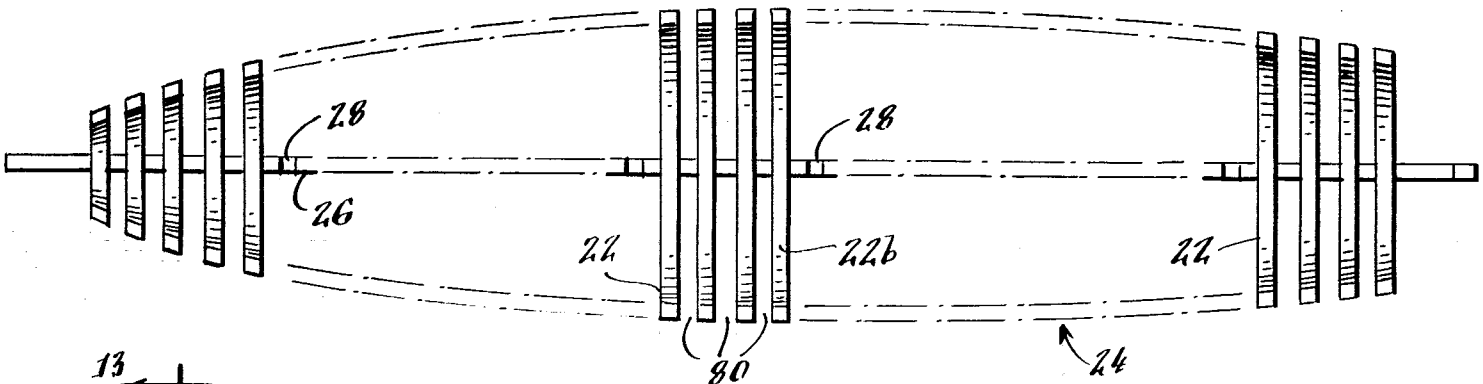
FIG. 11 is a top plan view of a set of assembled boat model frames formed in accordance with the invention.
Figure 12:
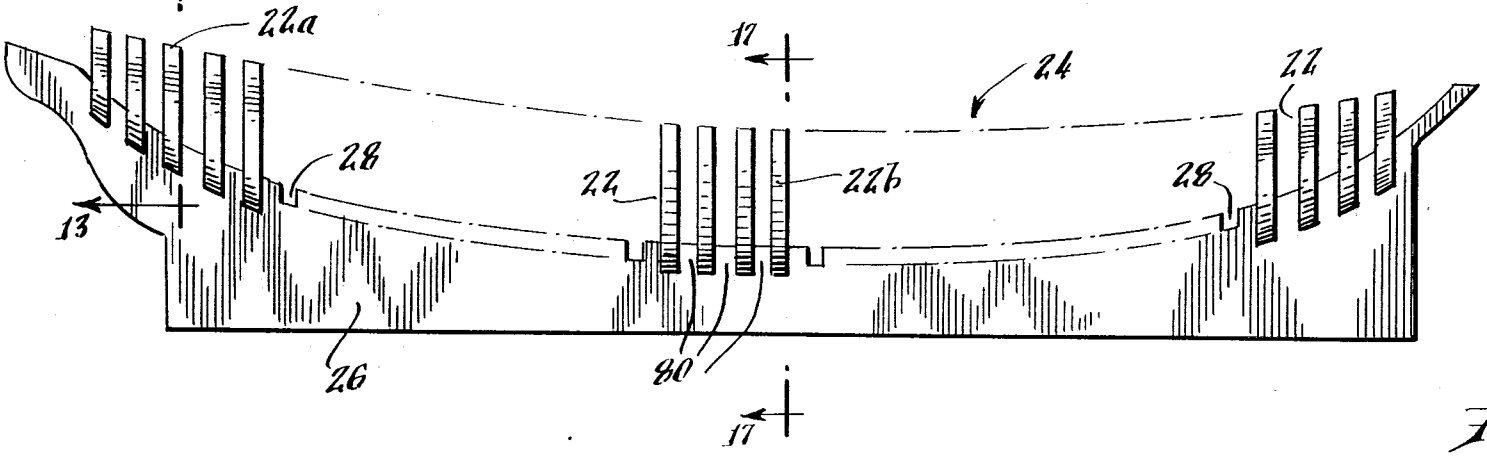
FIG. 12 is a side view in elevation of a set of assembled boat model frames formed in accordance with the invention.
Figures 13, 14, 15, 16, 17, 18, 19, 20:
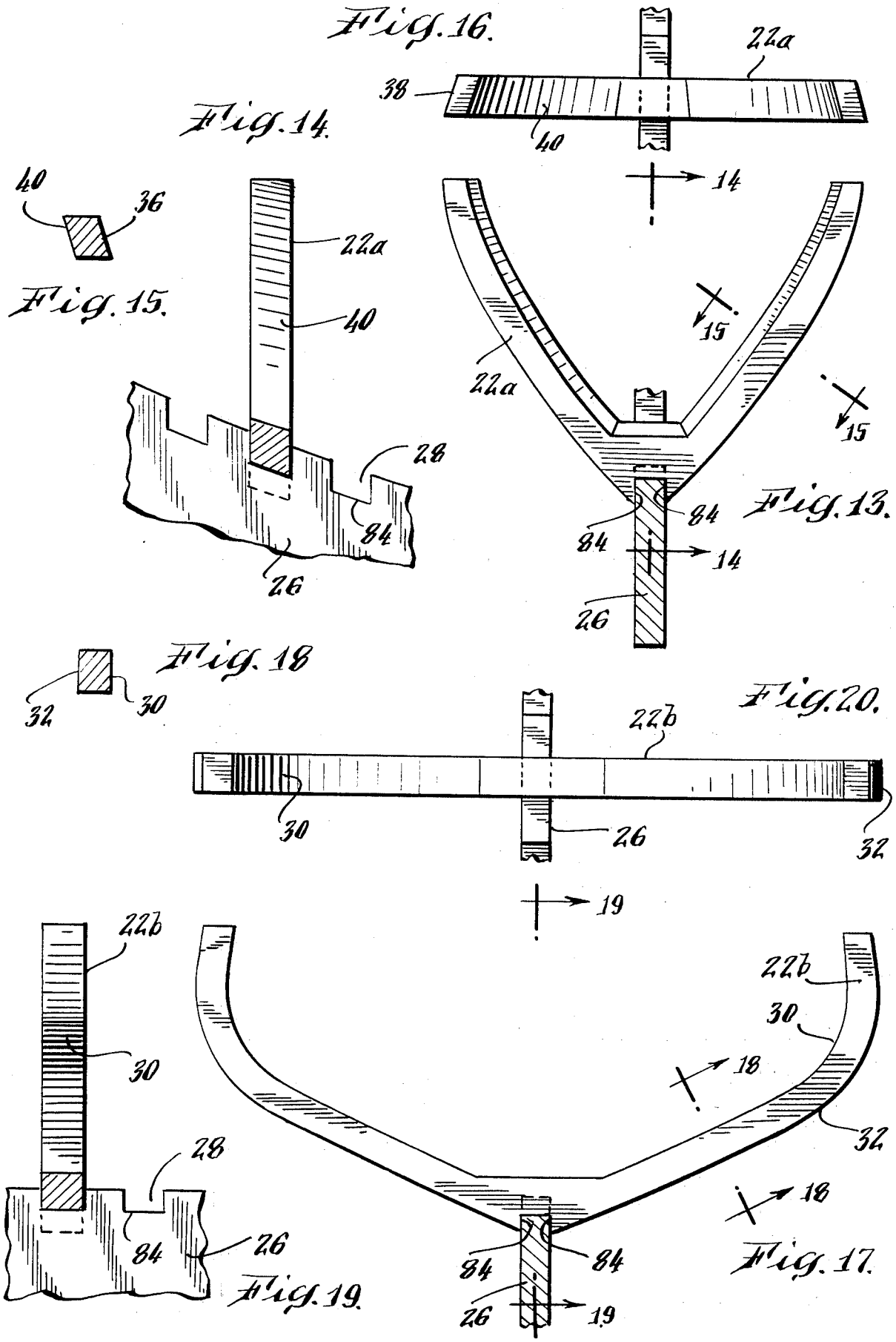
FIG. 13 is a section view of the boat model assembly of FIG. 12 taken along the line 13—13 therein.
FIG. 14 is a section view taken along the line 14—14 in FIG. 13.
FIG. 15 is a section view of a frame shown in FIG. 13 and as taken along the line 15—15 therein.
FIG. 16 is a top plan view of the frame shown in FIG. 13.
FIG. 17 is a section view of the boat model assembly of FIG. 12 taken along the line 17—17 therein.
FIG. 18 is a section view of a frame as taken along the line 18—18 in FIG. 17.
FIG. 19 is a section view as taken along the line 19—19 in FIG. 17.
FIG. 20 is a top plan view of the frame shown in FIG. 17.

After the entire boat hull has been sliced usually excepting a bow section 76 and a stern section 78, the formation of a set of frames can be made. This is done, for example, by selecting every other sliced frame 22 leaving gaps such as 80 (see FIGS. 11 and 12). The bow and stern sections 76, 78 may be used as part of the boat model kit by further processing these to remove portions 48 and 46 respectively. The selected frames 22 will have the desired beveled surfaces needed to form an authentic plank-on-frame boat model 20. The frames that are not selected may be used to make up another set.

The slicing of a boat hull 42 can be done with more than one saw 56 and a large number may be employed with spacings equal to the desired widths of the frames 22. The support of the boat hull may in such case be done with a cradle either such as 50 or in such other form that is capable of providing continuous support of the underside of each frame 22. Though the cradle described herein is manually manipulated, the process can be automated. Note from FIG. 8 that the boat hull 42 is provided with a slot 82 running along its bottom. This slot 82 is sized to enable each frame 22 to grip the bottom sides 84 of a slot 28 (see FIGS. 13, 14, 17 and 19) in keel 26.

Having thus described a method for making frames for an authentic plank-on-frame boat model, its advantages can be appreciated. A plurality of substantially identical sets of frames can be conveniently made, thus making such authentic boat model kits widely available. Variations from the described embodiments can be made without departing from the scope of the following claims.

What is claimed is:

1. A method for making frames for a boat model kit comprising the steps of:

forming a boat hull having an external surface shaped with a desired contour;

slicing the boat hull so as to intersect the external surface and divide the hull into segments to form the frames for the boat model.

2. The method for making frames as claimed in claim 1 wherein the forming step comprises:

forming a boat hull having its internal and external surfaces shaped in accordance with desired internal and external contours for the frames.

3. The method for making frames as claimed in claim 2 and further comprising:

externally supporting the boat hull along its external surface while slicing the hull.

4. The method for making frames as claimed in claim 3 wherein said slicing step further comprises the step of slicing said boat hull simultaneously at a plurality of places along the boat hull.

5. The method for making frames as claimed in claim 3 wherein said supporting step comprises the step of:

supporting the boat hull at discrete spaced locations along its external surface and wherein said slicing step is done between the locations where the boat hull is supported.

6. The method for making frames as claimed in claim 2 and further comprising:

placing the boat hull in a cradle support prior to slicing.

7. The method for making frames as claimed in claim 6 wherein the slicing step comprises:

slicing the boat hull and cradle support to form said frames.

8. The method for making frames for a boat model as claimed in claim 7 wherein said slicing step comprises slicing said boat hull and cradle support simultaneously with a plurality of saws.

9. The method for making frames for a boat model as claimed in clam 8 wherein said slicing step further comprises partially slicing the cradle support while fully slicing the boat hull so as to retain use of the cradle support for slicing another boat hull.

10. The method for making frames as claimed in claim 6 wehrein the placing step comprises:

placing the boat hull in a form having a recess shaped to receive and correspond to the external surface of the boat hull, and wherein said slicing step includes slicing the boat hull while it is placed in the form.

11. The method for making frames as claimed in claim 2 and further including the step of:

selecting predetermined ones of the sliced segments to form a set of said frames for a boat model.

12. The method for making frames as claimed in claim 11 wherein said selecting step comprises selecting alternate ones of the sliced segments to form the set of frames for a boat model.

13. The method for making frames as claimed in claim 2 and further comprising the step of:

externally supporting the boat hull prior to slicing at discrete places along the length of the hull and extending at said places laterally along peripherally continuous portions of the hull.

14. A frame for a boat model kit wherein the frame has different internally and externally beveled surfaces and made according to any one of the methods set forth in claims 1 through 13.

15. Frames for making boat model kits comprising:

a plurality of substantially identical sets of frames wherein the frames in each set define a desired contour of a common boat model, selected ones of said frames in each set having externally and internally beveled surfaces, as viewed from front to back with respect to the boat model, shaped to align with desired respective external and internal contours of the common boat model.

16. A method for making articles for making a boat model comprising:

producing a preform of the boat model with a surface thereof shaped with a desired contour; and slicing the preform so as to intersect the surface and divide the preform into segments to form the articles.

17. The method for making articles as claimed in claim 16 and further comprising:

externally supporting the preform along its external surface while slicing the preform.

18. The method for making articles as claimed in claim 17 and further comprising:

placing the preform in a cradle support prior to slicing.

* * * * *